United States Patent [19]

French

[11] Patent Number: 4,565,414

[45] Date of Patent: Jan. 21, 1986

[54] BATTERY CLAMP

[75] Inventor: Gerald H. French, St. Louis, Mo.

[73] Assignee: Associated Equipment Corporation, St. Louis, Mo.

[21] Appl. No.: 624,216

[22] Filed: Jun. 25, 1984

[51] Int. Cl.[4] ..... H01R 27/00

[52] U.S. Cl. ..... 339/32 R; 339/224; 339/261

[58] Field of Search ..... 339/32, 224, 225, 259 R, 339/261, 262 R, 227

[56] References Cited

U.S. PATENT DOCUMENTS

| | | | |
|---|---|---|---|
| 3,594,692 | 7/1971 | Oakes | 339/32 |
| 3,678,438 | 7/1972 | Gamson | 339/261 |
| 4,449,772 | 5/1984 | Johnson, III | 339/261 |

*Primary Examiner*—Gil Weidenfeld
*Assistant Examiner*—Paula Austin
*Attorney, Agent, or Firm*—Polster, Polster and Lucchesi

[57] ABSTRACT

The battery terminal clamp is capable of being received by batteries having either top post or side terminals. A connector is slidably carried between the clamp portions of a battery clamp. The connector includes a pair of longitudinal arms and interconnecting web providing a handle. The connector is selectively extensible beyond the connector jaws for engaging a battery side terminal. When connected to a battery side terminal the jaws engage the connector for applying pressure to the connector arms for assuring a good electrical and mechanical connection to the battery side terminal.

19 Claims, 5 Drawing Figures

BATTERY CLAMP

BACKGROUND OF THE INVENTION

This invention relates to battery clamps in general and in particular to a battery clamp which is capable of being received by a battery having either top posts or side terminals. In the past, automotive type batteries were provided with top posts terminals which were readily adaptable to connection by clamp jaws. In recent years a substantial number of automobile type batteries have been manufactured and utilized which incorporate side terminals. The particular mounting arrangements of such batteries in vehicles often makes it difficult to attach a conventional battery booster clamp directly to the terminal due to its close proximity of other metal objects such as fender walls and the like. Consequently, a number of extender connectors have been developed for use with side terminal batteries. Some of these devices are designed to be clipped to the battery side terminal bolts and then are capable of receiving a conventional battery booster clamp. Other devices have been incorporated directly into a battery booster clamp such as connectors that pivot or fold out of the way when not required and can be pivoted or folded to extend from the booster clamp for reaching battery side terminals.

Such side terminal connectors must first be capable of making good electrical connection to the battery side terminal bolt which requires substantial pressure of the device acting against the side terminal bolt; and the second must be readily attachable to and removable from the battery side terminal bolt a requirement which is facilitated by the use of minimal pressure of the device against the bolt. Prior devices provide substantially a uniform pressure on the connector device regardless of whether the devices is being initially connected or disconnected or is being used for battery boosting purposes without any provision for providing additional pressure after connect in order to assure good electrical contact.

SUMMARY OF THE INVENTION

This battery booster clamp provides a clamp capable of use with both posts and side terminal batteries in which additional clamping force is applied to a connector attached to the battery side terminal bolt once the connection has been made and such additional pressure is removed from the connector when the initial connection is being made and when disconnection occurs. This arrangement provides for a substantial low resistance electrical connection to handle the extremely high current flow that can occur when attempting to start an automobile engine and facilitates the attachment and removal of the device without requiring the use of excessive force.

The battery clamp includes a pair of opposed clamp portions hingedly connected, a biasing means operatively engaging the opposed clamp portions and tends to bias the clamp to a closed position and a side terminal connector carried by the clamp and selectively extensible beyond the clamp portions with the clamp portions selectively engaging the connector under the pressure of the biasing means for engagement with the battery side terminal.

In one aspect of the invention the clamp portions each include a jaw and the jaws selectively engage a connector. In another aspect of the invention a pivot pin hingedly connects the clamp portions and the connector is mounted about the pivot pin.

In yet another aspect of the invention the connector includes a longitudinal body having a longitudinal slot receiving the pivot pin, the terminal receiving end, and a handle end. The handle end includes an electrically insulating cover material. In still another aspect of the invention the terminal receiving end includes a first pair of opposed notches for receiving a first portion of the battery side terminal and a second pair of opposed notches for selectively receiving a second portion of the battery side terminal. The connector includes first and second cam members for facilitating connection of the connector to battery side terminal bolts.

DESCRIPTION OF THE PREFERRED EMBODIMENT

Figure 2:
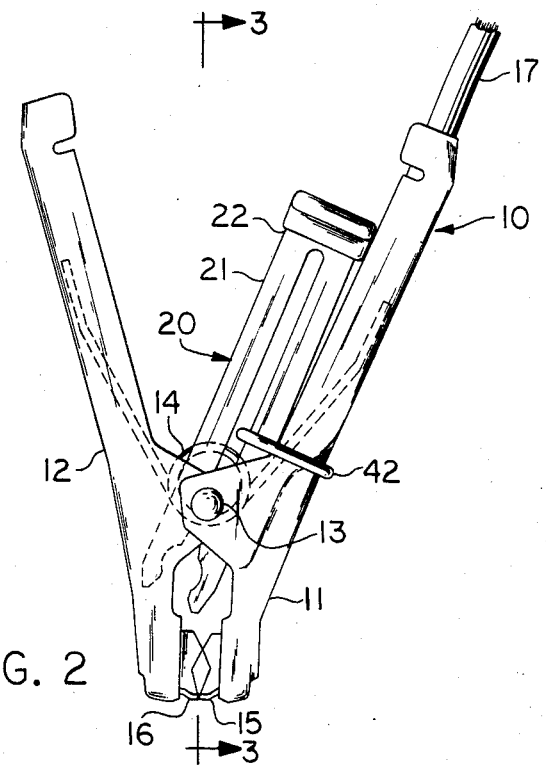
FIG. 2 is an elevational view of a battery clamp.

Referring now by characters of reference to the drawings and first to FIG. 2 it will be understood that the battery clamp indicated generally by 10 includes a pair of opposed clamp portions 11 and 12. A pivot pin 13 pivotally interconnects the clamp portions 11 and 12. Resilient means comprising wire spring 14 engages the clamp portions 11 and 12 and tends to urge the clamp 10 to a closed position as illustrated in FIG. 2.

Figure 3:
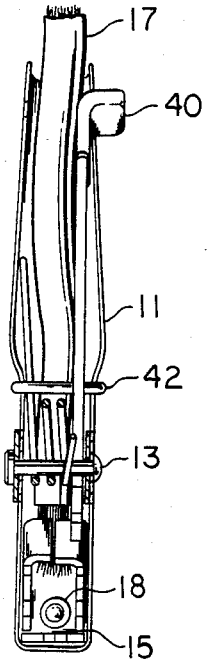
FIG. 3 is a cross sectional view of the battery clamp taken on line 3—3 of FIG. 2.

Clamp portion 11 includes a jaw 15 and clamp portion 12 includes a jaw 16. The jaws 15 and 16 can be integrally formed with the clamp portions 11 and 12, or as indicated in FIG. 3 of the preferred embodiment, can be separately formed and attached to the clamp portions 11 and 12 as by rivets 18. An electrical cable 17 is directly connected to the jaw 15.

It will be understood that what has heretofore been described constitutes a conventional battery clamp. The improved battery clamp 10 of the preferred embodiment includes a longitudinal connector generally indicated by 20 which, as most clearly indicated in FIG. 4, includes a pair of opposed longitudinal arms 21 having a web 22 interconnecting the arms 21 at their first ends and having second, longitudinally displaced, nonconnected ends 23. The arms include margins 24 which define a slot therebetween with the slot extending from the web 22 to the second ends 23.

The arm margins 24 further define stop members 25 which provide a reduced slot width at a point longitudinally spaced from the web 22. The connector 22 is carried by the clamp 10 with the pivot pin 13 received within the slot between the web 22 and stop members 25. It will be understood that the pivot pin 13 has a thickness or diameter that is greater than the reduced slot width at the stop members 25 thereby limiting longitudinal movement of the connector 22 relative to the clamp portions 11 and 12.

The margins 24 define opposed cam members 30 at the ends 23 of the arms 21. The margins 24 are provided with battery side terminal engaging opposed notches 31 adjacent to the cam members 30. Second opposed cam members 32 are included on the margins 24 adjacent to the notches 31 while second battery side terminal engaging opposed notches 33 are located on the margins 24 adjacent to the cam members 32. As illustrated in the preferred embodiment, the stop members 25 are located adjacent to the notches 33.

As is illustrated most clearly in FIG. 3, the web 22 provides a handle end for the terminal 20. The handle includes a portion 40 extending transversely from the plane on the longitudinal arm members 21. The handle of web 22 includes a covering of electrically insulating material such as thermoplastic material.

Referring now to FIGS. 2–5 it will be seen that a retaining means comprising a resilient O-ring 42 is received about the clamp portion 11 and through the slot of the terminal 22. The O-ring 42 engaging the connector 22 at a margin 24 for positioning of the terminal 22 within the clamp portions 11 and 12. Alternatively, other resilient retaining means such as a coil spring can be utilized in place of O-ring 42.

It is thought that the structural features and functional advantages of the battery clamp have become fully apparent from the foregoing description of parts but for completeness of disclosure a brief description of the operation and use of the battery clamp will be given.

Referring first to FIG. 2, with the connector 22 positioned between the clamp portions 11 and 12 and out of engagement with the jaws 15 and 16, the battery clamp 10 can be utilized with batteries having conventional top posts for connecting booster cables or battery chargers to such batteries in the conventional manner.

Figure 1:
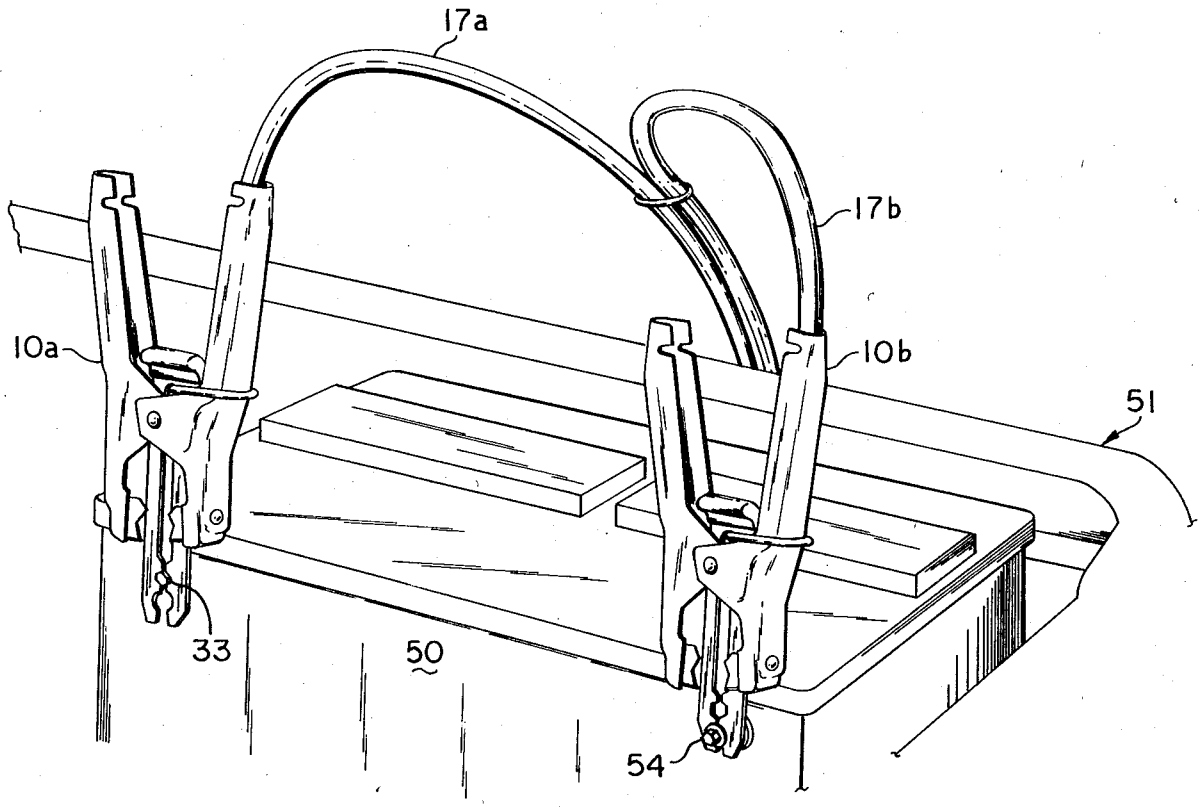
FIG. 1 is a perspective view of battery clamps shown connected to a battery side terminal.

Referring now to FIG. 1 a battery indicated by 50 is shown in a vehicle indicated generally by 51. The battery 50 includes a pair of side terminal bolts 53 and 54 of conventional design. A pair of battery booster clamps indicated as **10*a* and 10*b* are illustrated connected to the battery side terminal bolts 53 and 54 respectively. A pair of cables 17*a* and 17*b* are shown connected to the battery clamps 10*a* and 10*b*. For purposes of clarity the individual parts of the battery clamps 10*a* and 10*b* will be described utilizing the reference characters of the battery booster clamp 10 of FIGS. 2 through 5**.

Figure 4:
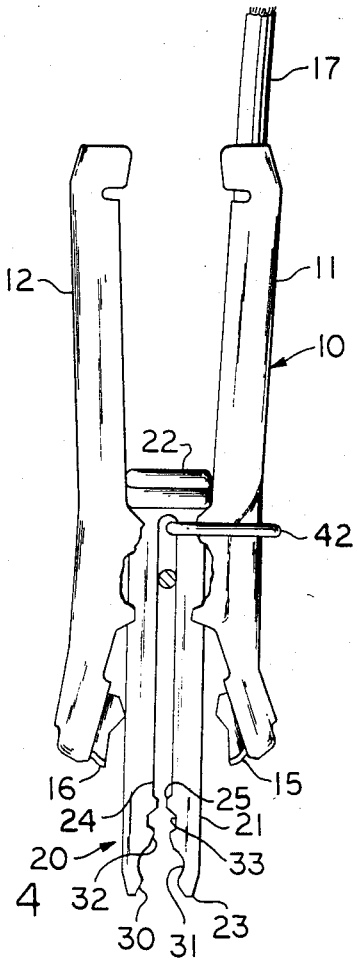
FIG. 4 is a fragmentary elevational view of the booster clamp showing the side terminal connector extended.
Figure 5:
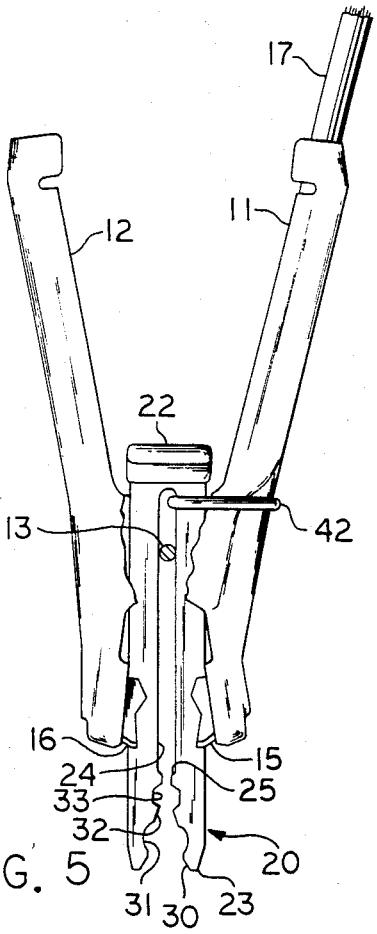
FIG. 5 is a fragmentary elevational view showing the jaw clamps closed on the connector.

The attachment of the battery clamps **10*a* and 10*b* to the battery 50 will be described by reference first to FIGS. 2, 4 and 5. It will be understood that the normal non-use position of the connector 20 is withdrawn within the battery clamp 10 as indicated in FIG. 2. When it is desired to utilize the battery clamp 10 to connect to the side terminals of a battery the clamp portions 11 and 12 are gripped and squeezed to open the jaws 15 and 16. It will be understood that the clamp portions 11 and 12 should be squeezed to a point between that which is illustrated in FIG. 4 and that which is illustrated in FIG. 5. With the battery booster clamp 10 so squeezed the connector 20 can be manually engaged at the handle web 22 and pushed downwardly so as to extend the arms 21 downwardly from and between the jaws 15 and 16 as indicated in FIG. 4. If the battery terminal portions 11 and 12 are now released the jaws 15 and 16 will close on the arms 21 in the manner indicated in FIG. 5. The jaws 15 and 16 engaging the arms 21 at a point at or below the longitudinal mid-point between the web 22 and the arm ends 23 for applying a biasing force to the arms 21 tending to urge the arms 21** together.

When it is desired to attach the connector 20 to a battery side terminal bolt 54 at its neck portion, the battery clamp portions 11 and 12 are gripped and squeezed tightly by hand in order that their margins can engage and hold the handle portion 40 of the connector 20. In this position the jaws 15 and 16 are no longer engaged with the arms 21 thereby relieving the pressure which they previously applied to the arms 21. The connector 20 can now be engaged with the neck portion of the side terminal bolt 54, the bolt will first engage the cam portions 30 and by applying a downward force to the battery clamp **10*b* the arms 21 will resiliently spread and allow the battery side terminal bolt 54 neck portion to be received in the notches 31** which are sized specifically to receive the neck portion.

With the connector 20 now properly positioned the connector portions 11 and 12 can be released to allow the jaws 15 and 16 to engage the arms 21. The jaw 15 providing the electrical connection to the connector 20 from the booster cable 17. The jaws 15 and 16 applying force to the arms 21 under bias of the wire spring 14 for providing a substantial mechanical and electrical connection to the battery side terminal bolt 54.

Upon completion of the desired battery charging or boosting operation, the battery clamp **10*b* can be removed from the battery side terminal bolt 54 by reversing a previously described procedure. First the battery clamp portions 11 and 12 and squeezed to relieve the pressure being applied to the arms 21. Then the battery clamp 10*b* is pulled vertically to pull the side terminal bolt 54 from the notches 31**.

To return the connector 20 into the battery clamp 10, the manual pressure being applied to the connector portions 11 and l2 can be slightly relieved so that their margins no longer engage the handle portion 40 while keeping the jaws 15 and 16 out of engagement with the arms 21. The handle portion 40 can then be manually grasped and pulled upwardly to slidably move the connector 20 relative to the terminal portions 11 and 12. It will be understood that the resilient O-ring 42 can be utilized to retain the connector 20 adjacent to the battery terminal portion 11 as indicated in FIG. 2. However, if it is not desired to have the connector so retained the O-ring 42 can be omitted.

The battery side clamp **10*a* is connected and disconnected from the battery 50 side terminals 53 in a similar manner. This battery clamp 10*a* is illustrated as connected to the head of a battery side terminal bolt 53. While the same procedure is utilized for connection and disconnection as for the battery clamp 10*b* the connector 20 receives the head of the battery side terminal bolt 53 within the notches 33. The bolt 53 engages the second cam portions 32 in order to spread the arms 21 and allow the head of the bolt 53 to enter the notches 33. By providing first and second sets of notches 31 and 33 the connector 20 can be utilized to connect it into a neck or head of a battery side terminal bolts 53 and 54** as may be appropriate for a particular circumstance.

Importantly, not only is the connector 22 retained within the clamp portions 11 and 12 when not in use but, furthermore, there is no electrical connection between the connector 20 and the battery cable 17 in such a position when the connector 20 is used with a conventional insulated battery clamp 10 as shown in FIG. 2 with the battery booster cable 17 is connected directly to the jaw 15. Furthermore, when the connector 20 is in use, the handle portion 40 which does extend outwardly of the battery clamp portions 11 and 12 is insulated, so as not to present possible electrical short problems should the handle portion 40 engage an electrically conductive portion of a vehicle with which it is being utilized. The only exposed electrically conductive portions connected to the booster cable 17 are at the jaws 15 and 16 and the portions of the arms 21 that extend therebelow.

I claim as my invention:

1. An improved battery clamp for use with top post and side terminal batteries in which a pair of opposed clamp portions are hingedly connected, and a biasing means operatively engages the opposed clamp portions and tends to bias the clamp to a closed position wherein the improvement comprises:

a side terminal connector carried by the clamp and selectively extensible beyond the clamp portions with the clamp portions selectively engaging the connector under the force of the biasing means for providing a battery side terminal engagement force to the connector.

2. An improved battery terminal clamp as defined in claim 1, in which:

the clamp portions each include a jaw and the jaws selectively engage the connector.

3. An improved battery terminal clamp as defined in claim 2, in which:

a pivot pin hingedly connects the clamp portions, and the connector is mounted about the pivot pin.

4. An improved battery terminal clamp as defined in claim 3, in which:

the connector includes a longitudinal body having a handle end and a terminal receiving end, the body is provided with a longitudinal slot extending from the vicinity of the handle to the terminal receiving end.

5. An improved battery terminal clamp as defined in claim 4, in which:

the clamp portions include handle portions which are selectively engageable with the connector handle end for holding the connector.

6. An improved battery terminal clamp as defined in claim 5, in which:

the connector handle end includes an electrically insulating cover material.

7. An improved battery terminal clamp as defined in claim 4, in which:

the terminal receiving end includes a first pair of opposed notches and a longitudinally spaced second pair of opposed notches formed in the longitudinal slot, the connector being selectably engageable with a battery side terminal at said first and second opposed notches.

8. An improved battery terminal clamp as defined in claim 1, in which:

the side terminal connector includes a pair of opposed longitudinal arms having first and second ends, a web interconnecting the arms at the first ends, and the arms have margins defining a slot therebetween extending from the web to the second ends.

9. An improved battery terminal clamp as defined in claim 8, in which:

the arms have a midpoint between their first and second ends, and the opposed clamp portions selectively engage the arms at a point substantially between the midpoint and the second end of each arm for providing the battery terminal engagement force to the connector.

10. An improved battery terminal clamp as defined in claim 8, in which:

the arm margins define stop member providing a reduced slot width at a point longitudinally spaced from the web.

11. An improved battery terminal clamp as defined in claim 10, in which:

a pivot pin hingedly connects the clamp portions and the connector is mounted to the clamp with the pivot pin within the slot between the web and the stop members.

12. An improved battery terminal clamp as defined in claim 11, in which:

the pivot pin has a thickness which is greater than said reduced slot width whereby extension of the connector beyond the clamp portions is limited by engagement of the pivot pin with the web and retraction of the connector within the clamp portion is limited by engagement of the pivot pin with the stop members.

13. An improved battery terminal clamp as defined in claim 10, in which:

the margins define first opposed cam members at the second ends of the arms, and the margins are provided with battery side terminal engaging opposed first notches adjacent to the first cam members.

14. An improved battery terminal clamp as defined in claim 13, in which:

the margins define second opposed cam members adjacent to the first notches, and the margins are provided with battery side terminal engaging opposed second notches adjacent to the second cam members.

15. An improved battery terminal clamp as defined in claim 14, in which:

the stop members are located adjacent to the second notches.

16. An improved battery terminal clamp as defined in claim 8, in which:

retaining means resiliently engages the connector for holding the connector adjacent to one of the clamp portions with the connector selectively positioned within the clamp portions.

17. An improved battery terminal clamp as defined in claim 16, in which:

the retaining means comprising a resilient ring.

18. An improved battery terminal clamp as defined in claim 17, in which:

the resilient ring engages the connector at one of the arm margins within the slot.

19. An improved battery terminal clamp as defined in claim 18, in which:

the resilient ring is an O-ring positioned about said one of the clamp portions.

* * * * *